US005657585A

United States Patent [19]

Zaccagni

[11] Patent Number: 5,657,585

[45] Date of Patent: Aug. 19, 1997

[54] COMBINATION SIDING PANEL-TRIMMING AND SOFFIT-PANEL MOUNTING MEMBER

[75] Inventor: Gregory R. Zaccagni, Aurora, Ill.

[73] Assignee: ZMC, Inc., Addison, Ill.

[21] Appl. No.: 568,627

[22] Filed: Dec. 7, 1995

[51] Int. Cl.[6] ..... E04B 7/00

[52] U.S. Cl. ..... 52/94; 52/518

[58] Field of Search ..... 52/60, 94, 97, 52/95, 518

[56] References Cited

U.S. PATENT DOCUMENTS

| | | | |
|---|---|---|---|
| 3,344,566 | 10/1967 | Miles et al. | 52/94 |
| 4,339,898 | 7/1982 | Pichette | 52/94 |
| 5,123,208 | 6/1992 | Kirby et al. | 52/60 X |
| 5,195,283 | 3/1993 | MacLeod et al. | 52/95 |
| 5,377,463 | 1/1995 | Howe | 52/94 X |

OTHER PUBLICATIONS

Armor Bond Building Products, Inc., DYNAFORGED Product Directory, front cover, pp. 1–6, and back cover, 1994—See "F Channel" on p. 2 and Undersill Trim on p. 4.

Omni Products, Omni Facade Installation Instructions, six pages, undated—admitted prior art.

Omni Fascia Installation Instructions, two pages undated—admitted prior art.

*Primary Examiner*—Carl D. Friedman

*Assistant Examiner*—Timothy B. Kang

*Attorney, Agent, or Firm*—Dressler, Goldsmith, Milnamow & Katz, Ltd.

[57] ABSTRACT

Being extruded in one piece from a polymeric material, such as polyvinyl chloride, and being useful with a soffit panel and with a siding panel, a combination siding panel-trimming and soffit panel-mounting member has a back panel, an upper front flange for overlying a back edge portion of a soffit panel, a lower front flange for underlying the back edge portion of the soffit panel, and a back flange for engaging an upper edge portion of the siding panel. The upper front flange projects from the back panel frontwardly, generally horizontally, and approximately at a right angle. The lower front flange projects from the back panel, has a portion projecting frontwardly and upwardly toward the upper front flange, and has a generally horizontal distal edge. The lower front flange has sufficient flexibility and sufficient resiliency to flex backwardly and upwardly from a normal position to a flexed position and to return, so as to permit the back edge portion of the soffit panel to move past the distal edge and the distal edge to move beneath the back edge portion of the soffit panel, when the back portion of the soffit panel is swung upwardly. The back flange projects from the back panel backwardly and defines a hook for interengaging with trim-engaging tabs on the upper edge portion of the siding panel.

11 Claims, 3 Drawing Sheets

COMBINATION SIDING PANEL-TRIMMING AND SOFFIT-PANEL MOUNTING MEMBER

TECHNICAL FIELD OF THE INVENTION

The present invention pertains to a combination siding panel-trimming and soffit panel-mounting member, which is extruded in one piece, preferably from polyvinyl chloride, and which is useful with a soffit panel having a back edge portion and with a siding panel having an upper edge portion formed with at least two laterally spaced trim-engaging tabs.

BACKGROUND OF THE INVENTION

As exemplified in Maloney, Jr., et al. U.S. Pat. No. 4,092,808, it is known to mount a soffit panel to a structure combining a gutter (eaves trough) and a facade by inserting a front edge portion of the soffit panel into a channel formed in the gutter-facade structure and by nailing a back edge portion of the gutter to a wooden nailing strip. As exemplified therein, the gutter and the soffit panel are roll-formed from aluminum coil stock, which may be pre-finished.

Improvements for mounting a front edge portion of such a soffit panel, as inserted into such a channel formed in such a gutter-facade structure, are disclosed in International Application No. PCT/US95/04922, as published as International Publication No. WO 95/30809. This invention provides improvements for mounting a back edge portion of such a soffit panel. Also, the present invention eliminates any need for a separate element, such as a wooden nailing strip.

Commonly, such a gutter and such a soffit panel are mounted to a building structure above aluminum siding panels including an uppermost panel, which extends upwardly approximately as far as the soffit panel, a separate element known as an undersill trim is nailed to a building wall, and the uppermost siding panel is punched so as to form trim-engaging tabs, by which the uppermost panel is secured to the undersill trim. The present invention provides improvements for securing such an uppermost siding panel. Also, the present invention eliminates any need for a separate element, such as an undersill trim.

SUMMARY OF THE INVENTION

This invention provides a combination siding panel-trimming and soffit panel-mounting member, which is extruded in one piece, and which is useful with a generally horizontal soffit panel having a back edge portion and with a generally vertical siding panel having an upper edge portion formed with at least two laterally spaced trim-engaging tabs.

The combination member has a generally vertical back panel, an upper front flange for overlying the back edge portion of the soffit panel, a lower front flange for underlying the back edge portion of the soffit panel, and a back flange for engaging the upper edge portion of the siding panel.

The upper front flange projects from the back panel frontwardly and generally horizontally. The lower front flange projects from the back panel and, in a preferred embodiment, has a portion projecting frontwardly and upwardly toward the upper front flange. The lower front flange has a generally horizontal distal edge.

In the preferred embodiment, the lower front flange has sufficient flexibility and sufficient resiliency to flex backwardly and upwardly from a normal position to a flexed position and to return from the flexed position to the normal position, so as to permit the back edge portion of the soffit panel to move past the distal edge and the distal edge to move beneath the back edge portion of the soffit panel, when the back edge portion of the soffit panel is swung upwardly.

The back flange projects from the back panel backwardly. The back flange defines a hook for interengaging with the trim-engaging tabs on the upper edge portion of the siding panel. In some applications, as in some applications wherein such a siding panel is not used, the back flange is not needed and may be optionally omitted.

Preferably, the back panel has a lower edge, from which the lower front flange projects. Preferably, if used, the back flange also projects from the lower edge of the back panel.

Preferably, the back panel has an upper portion and a lower portion joined to the upper portion at a generally horizontal juncture, which has a stepped profile causing the lower portion of the back panel or the upper and lower portions of the back panel to be frontwardly disposed with relation to the upper portion of the back panel. Preferably, moreover, the upper front flange projects from the generally horizontal juncture.

These and other objects, features, and advantages of this invention are evident from the following description of a preferred embodiment of the present invention with reference to the accompanying drawings.

DETAILED DESCRIPTION OF THE PREFERRED EMBODIMENT

Figure 1:
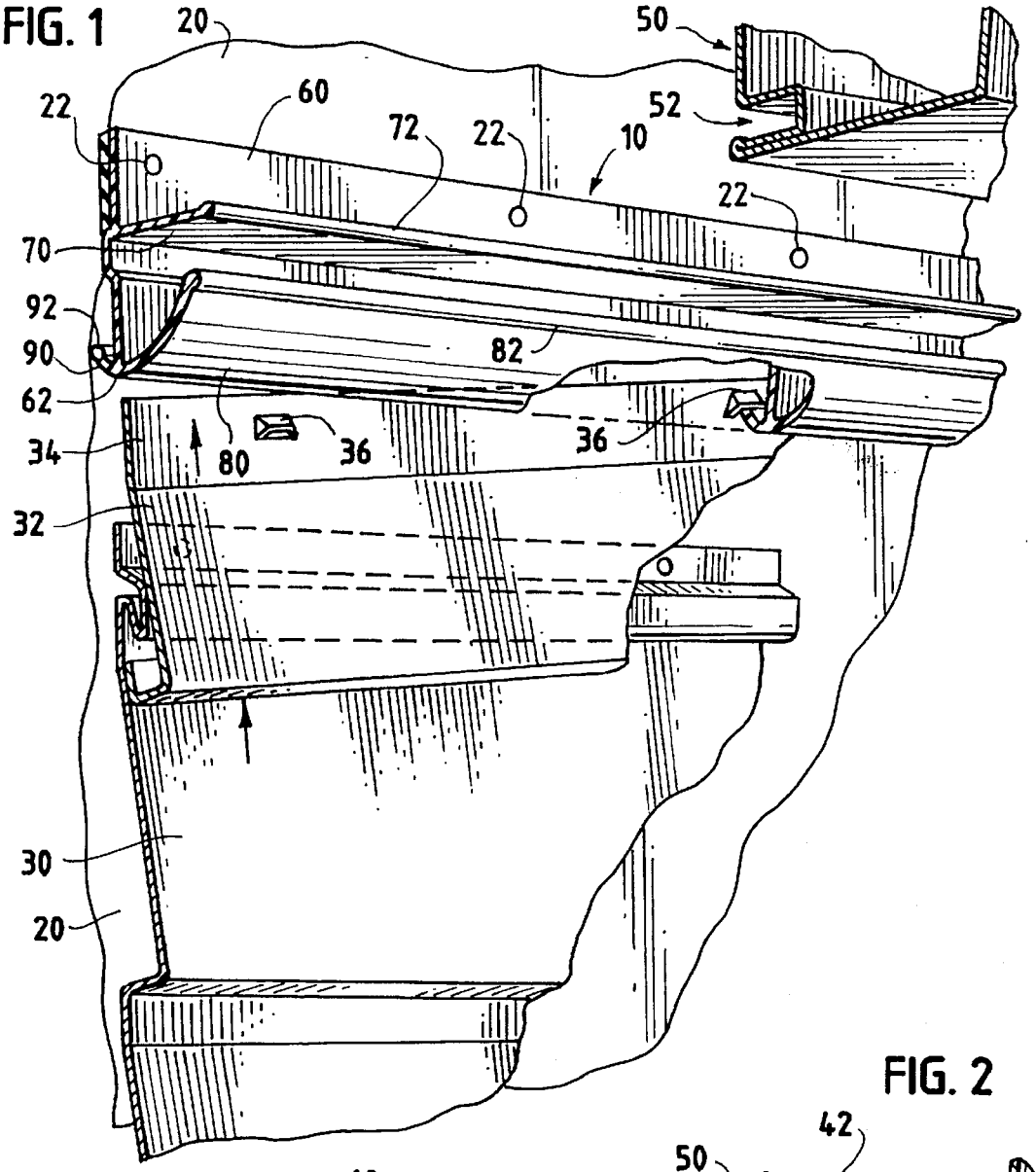
FIG. 1 is a fragmentary, perspective view of a building wall, a gutter, siding panels, and a combination siding panel-trimming and soffit panel-mounting member according to the present invention. An uppermost siding panel provided with laterally spaced trim-engaging tabs is shown as such panel is being mounted to the combination member via such tabs and a back flange of the combination member.
Figure 2:
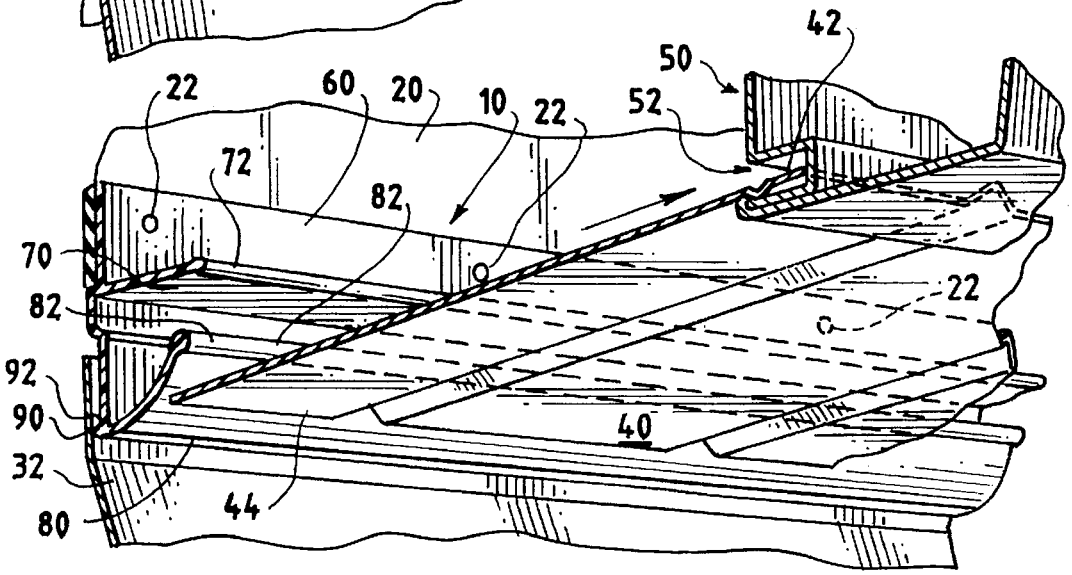
FIG. 2 is a fragmentary, perspective view of the building wall, the gutter, the uppermost siding panel, and the combination member, together with a soffit panel. The soffit panel is shown as a front edge portion of the soffit panel is being inserted into a channel formed in the gutter.

As shown in FIGS. 1 through 5, a combination siding panel-trimming and soffit panel-mounting member 10 constitutes a preferred embodiment of the present invention. The combination member 10 is mounted to a building wall 20 via nails 22. The combination member 10 is used with generally vertical siding panels 30, which include an uppermost siding panel 32, a generally horizontal soffit panel 40, and a gutter-facade structure 50. The combination member 10 is used in mounting the uppermost siding member 32 without any need for a separate element, such as an undersill trim, and in mounting the soffit panel 40 without any need for a separate element, such as a wooden nailing strip. Preferably, the siding panels 30, the soffit panel 40, and the gutter-facade structure 50 are roll-formed from aluminum coil stock, which has been pre-painted. A back panel 60 of the combination member 10 may be suitably marked, indented, or punched with holes where the nails 22 may be optimally driven.

The uppermost siding panel 32 is punched along an upper edge portion 34, in a known manner, so as to have laterally spaced trim-engaging tabs 36. A punching tool suitable for punching the uppermost siding panel 32 is available commercially from Omni Products (a division of ZMC, Inc.) of Addison, Ill., under Product Code No. VS9700.

The soffit panel 40 has a front edge portion 42 and a back edge portion 44. The gutter-facade structure 50 is formed with a channel 52, into which the front edge portion 42 of the soffit panel 40 is inserted. Preferably, the soffit panel 40 and the gutter-facade structure 50 are interconnected, where the front edge portion 42 of the soffit panel 40 is inserted into the channel 52, in a manner disclosed in International Publication No. WO 95/30809, supra, the disclosure of which is incorporated herein by reference. Alternatively, the soffit panel 40 and the gutter-facade structure 50 are associated, where the front edge portion 42 of the soffit panel 40 is inserted into the channel 52, in a manner disclosed in U.S. Pat. No. 4,092,808, supra, the disclosure of which is incorporated herein by reference.

As extruded from a suitably flexible, suitably resilient, polymeric material, such as polyvinyl chloride, the combination member 10 has a generally vertical back panel 60, an upper front flange 70 for overlying the back edge portion 44 of the soffit panel 40, a lower front flange 80 for underlying the back edge portion 44 of the soffit panel 40, and a back flange 90 for engaging the upper edge portion 34 of the uppermost siding panel 32. The upper front flange 70 projects from the back panel 60 frontwardly, generally horizontally, and approximately at a right angle. The upper front flange 70 has a generally horizontal distal edge 72, which is enlarged in cross-section with relation to the remainder of such flange 70. The back panel 60 has a lower edge 62, from which lower front flange 80 projects. In a preferred version of the combination member 10, as shown in FIGS. 1 through 5, the lower front flange 80 projects frontwardly and upwardly toward the upper front flange. The lower front flange 80 has a generally horizontal distal edge 82, which is enlarged in cross-section with relation to the remainder of such flange 80. The upper front flange 70 may be truly horizontal, as shown, or may be downwardly inclined by a small angle (e.g. about 10°) from true horizontal, when unstressed, so as to provide a tight fit for the soffit panel 40 between the upper front flange 70 and the lower front flange 80.

Figure 3:
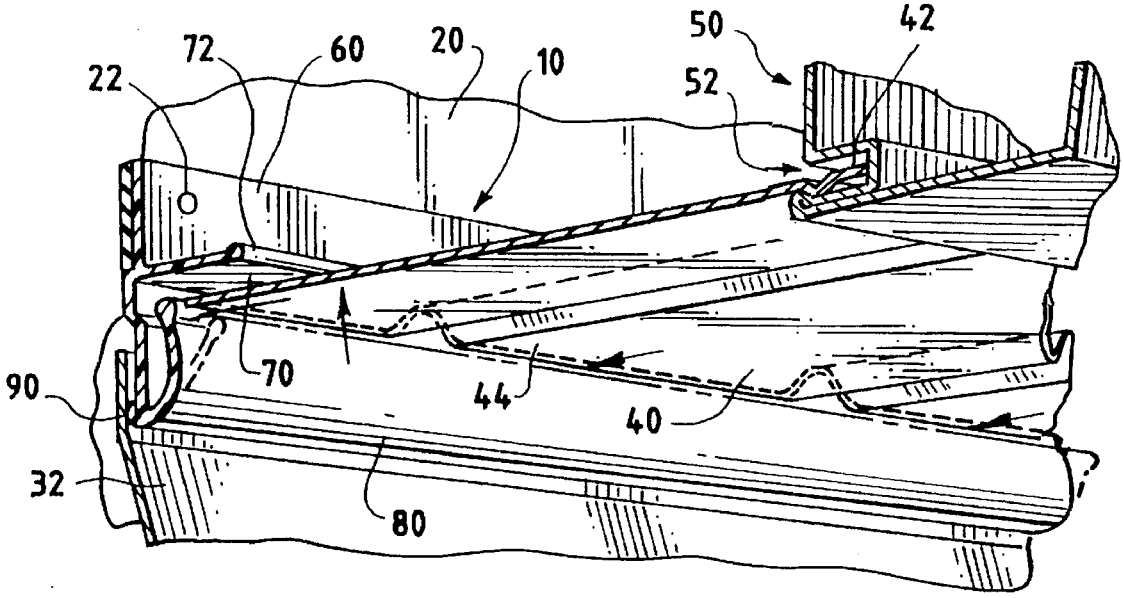
FIG. 3 is a fragmentary, perspective view of the building wall, the gutter, the uppermost siding panel, the soffit panel, and the combination member. The soffit panel is shown as a back edge portion of the soffit panel is being mounted between an upper front flange of the combination member and a lower front flange of the combination member.
Figure 4:
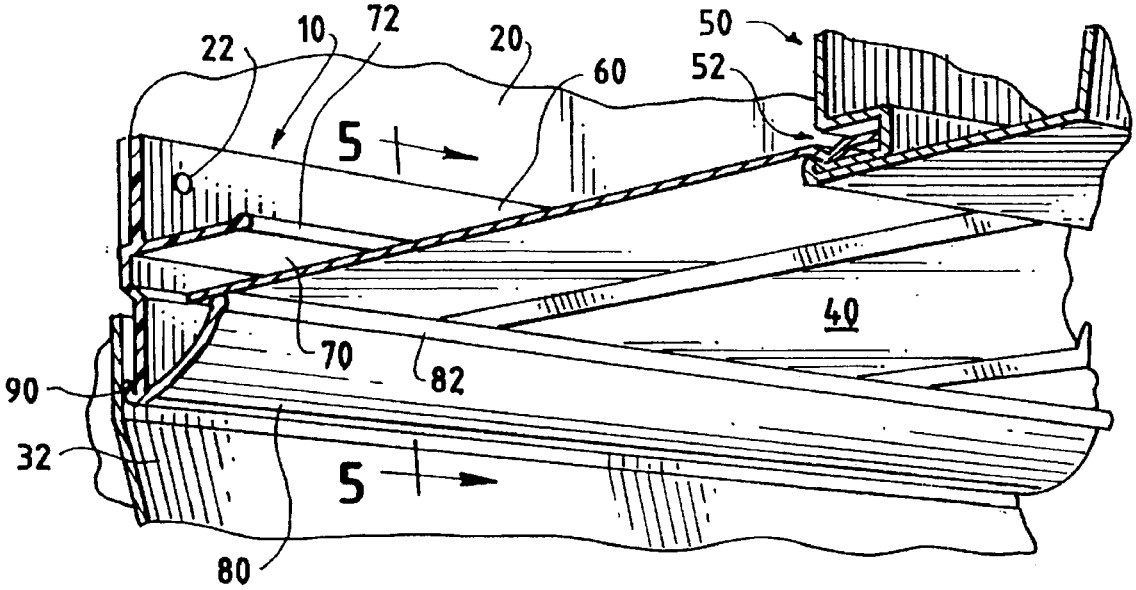
FIG. 4 is a fragmentary, perspective view of the building wall, the gutter, the uppermost siding panel, the soffit panel, and the combination member. The soffit panel is shown after the back edge portion of the soffit panel has been mounted between the upper front flange of the combination member and the lower front flange of the combination member.
Figure 5:
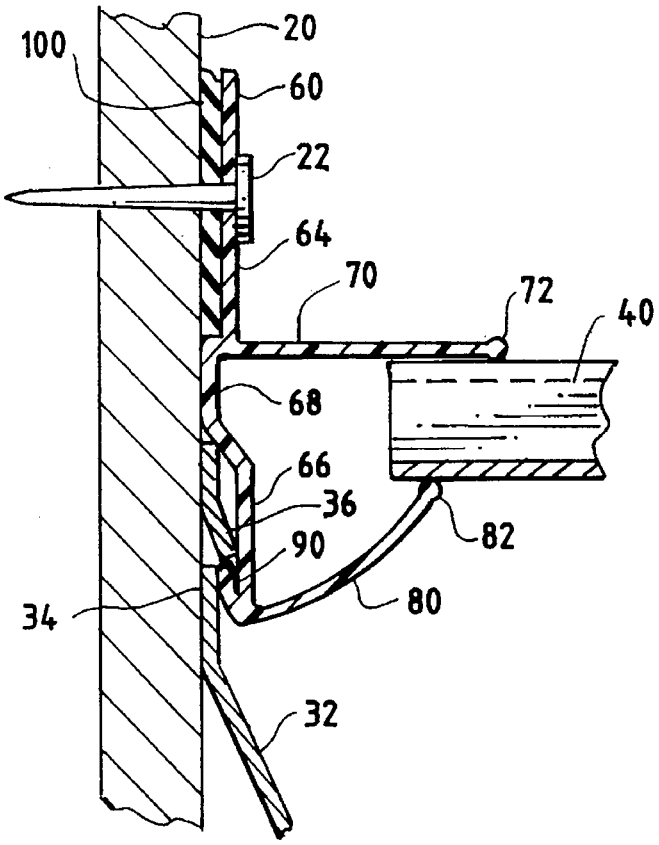
FIG. 5 is a fragmentary, sectional view taken along line 5—5 of FIG. 4, in a direction indicated by arrows.

In FIGS. 1, 2, 4, and 5, the lower front flange 80 is shown in a normal position. In FIG. 3, the lower front flange 80 is shown in a flexed position in full lines and in the normal position in broken lines. As suggested by arrows in FIG. 3, the lower front flange 80 has sufficient flexibility and sufficient resiliency to flex backwardly and upwardly from a normal position to a flexed position and to return from the flexed position to the normal position, so as to permit the back edge portion 44 of the soffit panel 40 to move past the distal edge 86 and the distal edge 86 to move beneath the back edge portion 44 of the soffit panel 40, when the back edge portion 44 of the soffit panel 40 is swung upwardly.

In the preferred version of the combination member 10, as shown in FIGS. 1 through 5, the back panel 60 has a stepped profile with an upper portion 64 and a lower portion 66 joined to the upper portion 64 at a generally horizontal juncture 68, which has a stepped profile causing the upper portion 64 and the lower portion 66 to be frontwardly disposed with relation to the generally horizontal juncture 68. A sealing gasket 100 is disposed between the upper portion 64 and the building wall 20. The upper edge portion 34 of the uppermost soffit panel 32 is interposed between the lower portion 66 and the building wall 20.

The back flange 90 has a distal edge and projects from the lower edge 62 of the back panel 60 backwardly and upwardly so as to interengage with the trim-engaging tabs 36 on the upper edge portion 34 of the uppermost siding panel 32, as shown in FIG. 1, whereby the uppermost siding panel 32 hangs from the back flange 90. The back panel 60 and the back flange 90 have sufficient flexibility and sufficient resiliency to flex so as to permit such tabs 36 to move upwardly past the distal edge 92 of the back flange 90 when the upper edge portion 34 of the uppermost siding panel 32 is pushed upwardly behind the lower portion 66 of the back panel 60.

Figure 6:
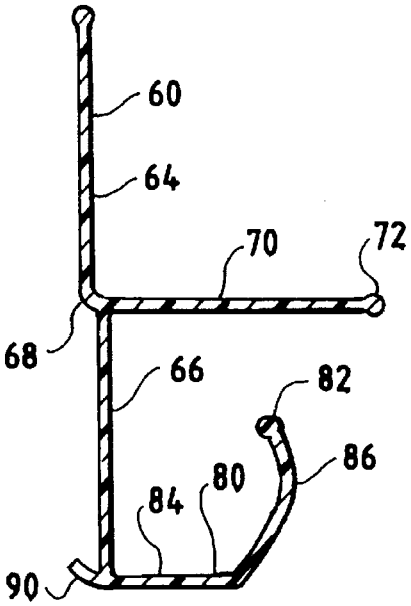

In an alternative version of the combination member 10, as shown in FIG. 6, the back panel 60 has a stepped profile with an upper portion 64 and a lower portion 66 joined to the upper portion 64 at a generally horizontal juncture 68, which has a stepped profile causing the lower portion 66 (but not the upper portion 64) to be frontwardly disposed with relation to the generally horizontal juncture 68. The upper edge portion 34 of the uppermost soffit panel 32 is interposed between the lower portion 66 and the building wall 20. Moreover, the lower front flange 80 has a proximal portion 84 projecting from the lower edge 62 of the back panel 60 frontwardly, generally horizontally, and approximately at a right angle and a distal portion 86 projecting from the proximal portion 84 and curving upwardly toward the upper front flange 70 and backwardly toward the back panel 60.

Figure 7:
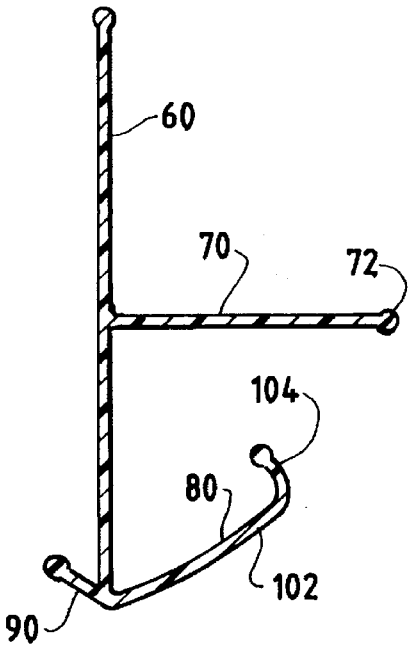
FIGS. 6, 7, and 8 are cross-sectional views taken through alternative versions of the combination member.
Figure 8:
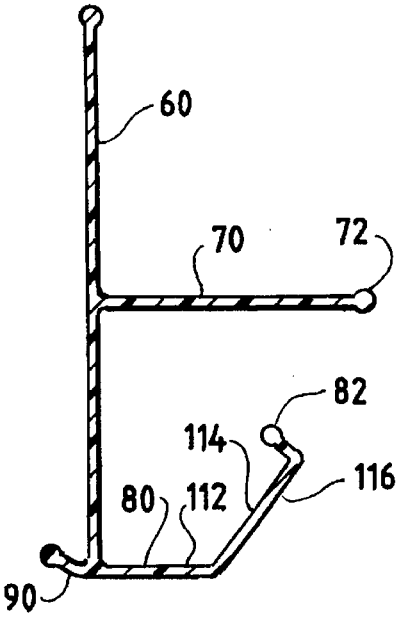

In other alternative versions of the combination member 10, as shown in FIGS. 7 and 8, the back panel 60 has a straight profile. In the alternative version of FIG. 7, a proximal portion 102 of the lower front flange 80 projects from the lower edge 62 of the back panel 60 and projects frontwardly and upwardly, and a distal portion 104 of the lower front flange 80 projects from the proximal portion 102 and projects backwardly and upwardly. In the alternative version of FIG. 8, a proximal portion 112 of the lower front flange 80 projects from the lower edge 62 of the back panel 60 and projects frontwardly, an intermediate portion 114 of the lower front flange 80 projects from the proximal portion 112 and projects frontwardly and upwardly toward the upper front flange 70, and a distal portion 116 of the lower front flange 80 projects from the intermediate portion 114 and projects backwardly and upwardly.

Various modifications may be made in the preferred embodiment described above without departing from the scope and spirit of this invention.

The invention claimed is:

1. A combination comprising a generally horizontally soffit panel having a back edge portion, a generally vertical siding panel having an upper edge formed with at least two laterally spaced trim-engaging tabs, and a combination siding panel-trimming and soffit panel-mounting member, said member having a generally vertical back panel, said member having means including an upper front flange projecting frontwardly from the back panel and overlying the back edge portion of the soffit panel and a lower front flange projecting frontwardly from the back panel and underlying the back edge portion of the soffit panel for mounting the back edge portion of the soffit panel, said member having means including a back flange projecting from the back panel, the back flange defining a hook interengaging with the trim-engaging tabs on the upper edge portion of the siding panel, for trimming and mounting the upper edge portion of the siding panel so as to conceal the upper edge portion of the siding panel and said tabs behind the back panel.

2. The combination of claim 1 wherein the upper front flange projects frontwardly and generally horizontally from the back panel, wherein the lower front flange has a portion projecting frontwardly and upwardly toward the upper front flange and has a generally horizontal distal edge, and wherein the lower front flange has sufficient flexibility and sufficient resiliency to flex backwardly and upwardly from a normal position to a flexed position and to return from the flexed position to the normal position, so as to permit the back edge portion of the soffit panel to move past the distal edge and the distal edge to move beneath the back edge portion of the soffit panel, when the back edge portion of the soffit panel is swung upwardly.

3. The combination member of claim 2 wherein the back flange has a lower edge, from which the lower front flange projects.

4. The combination member of claim 3 wherein the back flange also projects from the lower edge of the back panel.

5. The combination member of claim 2 wherein the back panel has a lower edge, from which the back flange projects.

6. The combination member of claim 2 wherein the back panel has an upper portion and a lower portion joined to the upper portion at a generally horizontal juncture, which has a stepped profile causing the lower portion of the back panel to be frontwardly disposed with relation to the generally horizontal juncture.

7. The combination member of claim 6 wherein the upper front flange projects from the generally horizontal juncture.

8. The combination member of claim 2 wherein the back panel has an upper portion and a lower portion joined to the upper portion at a generally horizontal juncture, which has a stepped profile causing the upper and lower portions of the back panel to be frontwardly disposed with relation to the generally horizontal juncture.

9. The combination member of claim 8 wherein the upper front flange projects from the generally horizontal juncture.

10. The combination of any one of the preceding claims wherein said member is extruded in one piece.

11. The combination of claim 10 wherein said member is extruded from a polymeric material.

* * * * *